US009488172B2

(12) United States Patent
Rhein

(10) Patent No.: US 9,488,172 B2
(45) Date of Patent: Nov. 8, 2016

(54) PUMP ASSEMBLY FOR A VEHICLE

(75) Inventor: Robert E. Rhein, Clarkston, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 153 days.

(21) Appl. No.: 13/479,758

(22) Filed: May 24, 2012

(65) Prior Publication Data

US 2013/0315770 A1 Nov. 28, 2013

(51) Int. Cl.
*F04C 2/08* (2006.01)
*F04C 2/10* (2006.01)
*F04C 15/00* (2006.01)

(52) U.S. Cl.
CPC ..... *F04C 2/086* (2013.01); *F04C 2/102* (2013.01); *F04C 15/0088* (2013.01); *F04C 2240/54* (2013.01); *F04C 2250/10* (2013.01)

(58) Field of Classification Search
CPC .. B60T 8/4022; B60T 8/4031; B60T 8/4054; B60T 8/4881; F04C 2240/10; F04C 2/086; F04C 15/0088; F04C 2/102
USPC ..... 418/171, 83, 96, 99, 160, 161, 164, 418/166, 75; 417/310
See application file for complete search history.

(56) References Cited

U.S. PATENT DOCUMENTS 1,970,146 A * 8/1934 Hill ..... 418/71
3,680,989 A * 8/1972 Brundage ..... 418/71
3,824,047 A * 7/1974 McDermott ..... F01C 21/10 418/171
3,834,842 A * 9/1974 Dorff ..... F04C 15/0042 418/171
3,907,465 A * 9/1975 Dorff et al. ..... 418/71
5,947,567 A * 9/1999 Jonner et al. ..... 303/115.4
7,278,841 B2 * 10/2007 Phillips ..... 418/132
7,637,725 B2 * 12/2009 Berger ..... 418/61.3
2003/0108445 A1 6/2003 Kawasaki et al.
2008/0019846 A1 * 1/2008 White ..... F04C 2/102 417/310
2011/0038746 A1 * 2/2011 Eisenmann ..... 418/166

FOREIGN PATENT DOCUMENTS

CN 1414246 A 4/2003
CN 1902401 A 1/2007
EP 1710436 A1 10/2006
GB 903788 A 8/1962
JP 2005120850 A 5/2005

* cited by examiner

*Primary Examiner* — Kenneth Bomberg
*Assistant Examiner* — Paul Thiede
(74) *Attorney, Agent, or Firm* — Quinn Law Group, PLLC

(57) ABSTRACT

A pump assembly for a vehicle is disclosed. The pump assembly includes a housing defining a cavity extending along a central axis to present a wall disposed radially relative to the central axis and a base transverse to the central axis. The pump assembly also includes a first gear disposed in the cavity. The first gear has a first side and a second side each extending along the central axis. The first side faces the wall and the second side opposes the first side. The first side of the first gear is complementary to the wall. The wall defines a recess adjacent to the cavity and spaced from the base. The recess is in fluid communication with the cavity for providing lubrication between the wall and the first side of the first gear.

20 Claims, 4 Drawing Sheets

PUMP ASSEMBLY FOR A VEHICLE

TECHNICAL FIELD

The present disclosure relates to a pump assembly for a vehicle.

BACKGROUND

Various vehicles may include a pump. One type of pump includes a housing defining a pump pocket and an opening intersecting the pump pocket, with the opening extending the same length as the pump pocket. In other words, the pump pocket and the opening extend the same length between a top surface and a bottom surface. A gear is disposed in the pump pocket and the position of the gear can change due to the opening and the pocket being the same length. Furthermore, building up an oil film on the gear can be inconsistent due to the opening and the pocket defining the same length.

SUMMARY

The present disclosure provides a pump assembly for a vehicle. The pump assembly includes a housing defining a cavity extending along a central axis to present a wall disposed radially relative to the central axis and a base transverse to the central axis. The pump assembly also includes a first gear disposed in the cavity. The first gear has a first side and a second side each extending along the central axis. The first side faces the wall and the second side opposes the first side. The first side of the first gear is complementary to the wall. The wall defines a recess adjacent to the cavity and spaced from the base. The recess is in fluid communication with the cavity for providing lubrication between the wall and the first side of the first gear.

The present disclosure also provides a pump assembly for a vehicle. The pump assembly includes a housing defining a cavity extending along a central axis to present a wall disposed radially relative to the central axis and a base transverse to the central axis. The pump assembly also includes a first gear disposed in the cavity and having a first side and a second side each extending along the central axis. The first side faces the wall and the second side opposing the first side. The first side of the first gear is complementary to the wall. The pump assembly further includes a second gear disposed in the cavity and spaced from the wall. The first gear is disposed between the second gear and the wall. The first gear defines teeth and the second gear defines teeth cooperating with the teeth of the first gear such that rotation of one of the first and second gears causes rotation of an other one of the first and second gears. The pump assembly also includes a motor coupled to the second gear for rotating the second gear which rotates the first gear. The motor includes a flange for attaching the housing to the motor. The wall defines a recess adjacent to the cavity and spaced from the base. The recess is in fluid communication with the cavity for providing lubrication between the wall and the first side of the first gear. The housing presents a face disposed transverse to the central axis and including a first edge adjacent to the wall. The recess intersects the first edge such that the face further defines the recess and the first edge defines a non-continuous configuration. The base includes a second edge spaced from the first edge along the central axis. The face and the base are spaced from each other, and the second edge is adjacent to the wall and defines a continuous configuration. The recess extends along the central axis toward the base to present a bottom spaced from the second edge of the base. The recess defines a first height between the face and the bottom, and the wall defining a total height between the face and the base. The first height is from about 80% to about 85% less than the total height. The housing defines a first plane disposed transverse to the central axis and substantially parallel to the face of the housing. The housing also defines a second plane disposed transverse to the first plane, with the second plane spaced from the first and second slots and the second plane intersecting the recess.

The detailed description and the drawings or Figures are supportive and descriptive of the disclosure, but the scope of the disclosure is defined solely by the claims. While some of the best modes and other embodiments for carrying out the claims have been described in detail, various alternative designs and embodiments exist for practicing the disclosure defined in the appended claims.

DETAILED DESCRIPTION

Figure 1:
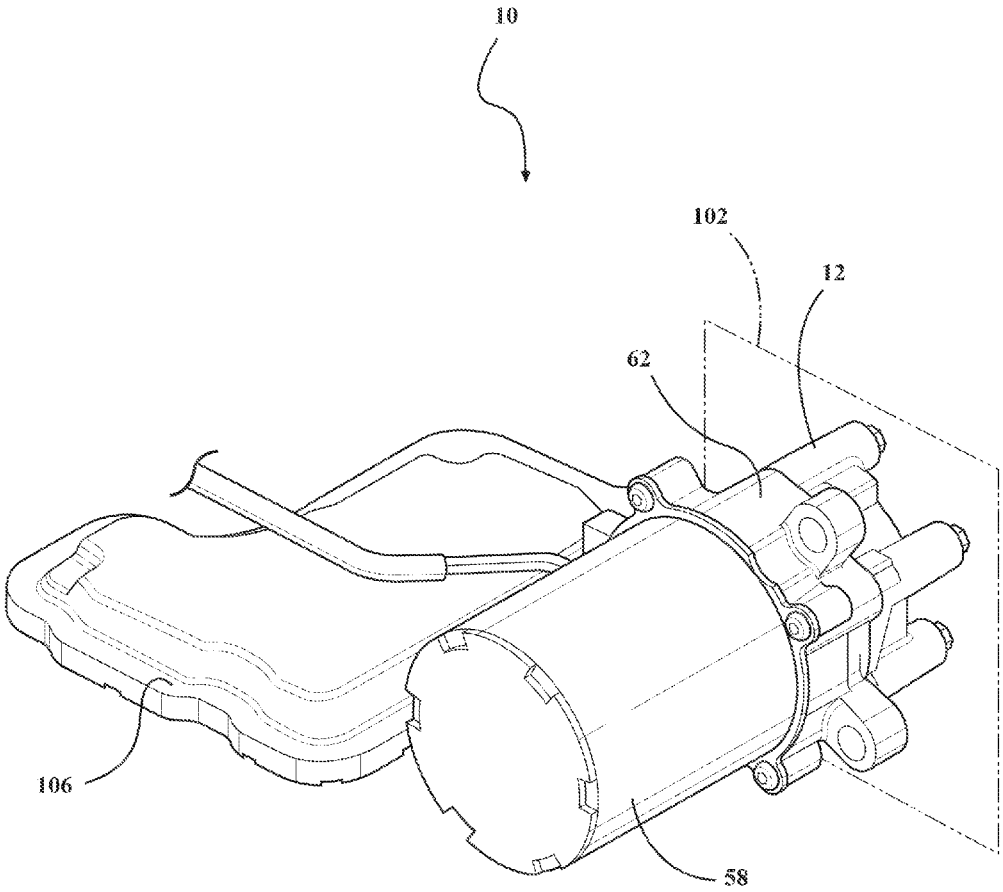
FIG. 1 is schematic perspective view of a pump assembly.
Figure 2:
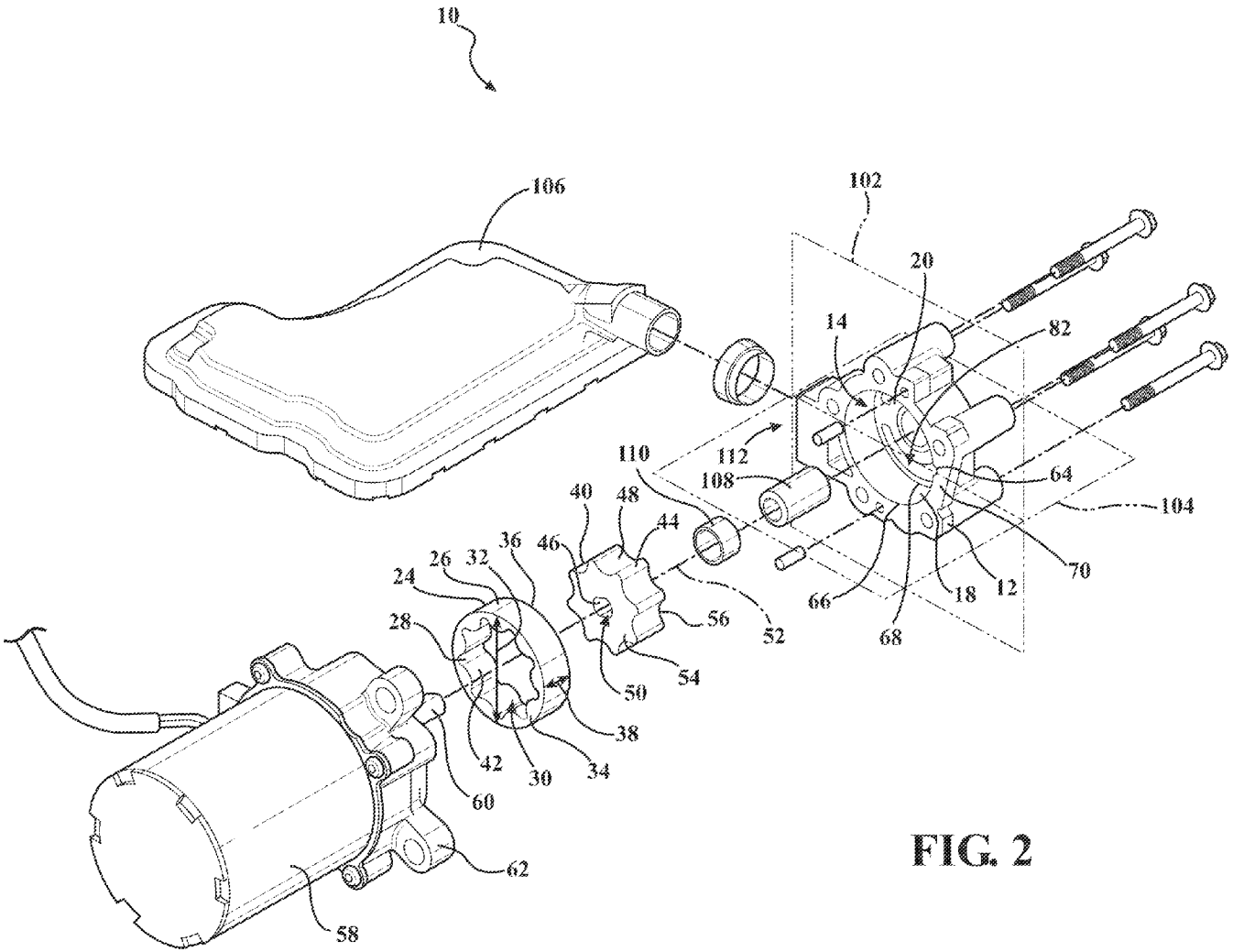
FIG. 2 is schematic exploded perspective view of the pump assembly.
Figure 3:
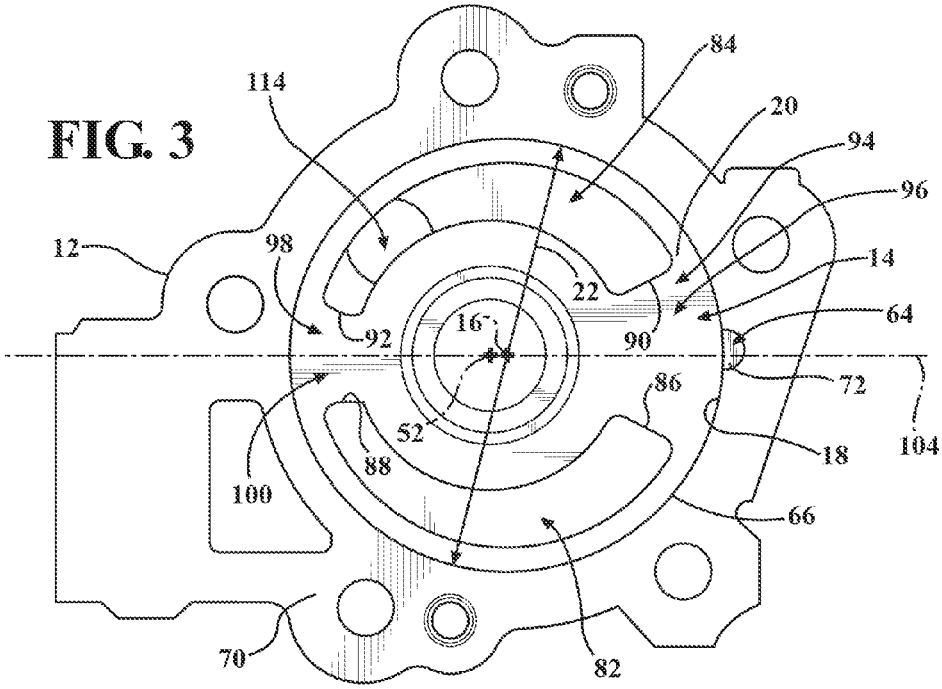
FIG. 3 is schematic end view of a housing defining a cavity.
Figure 4:
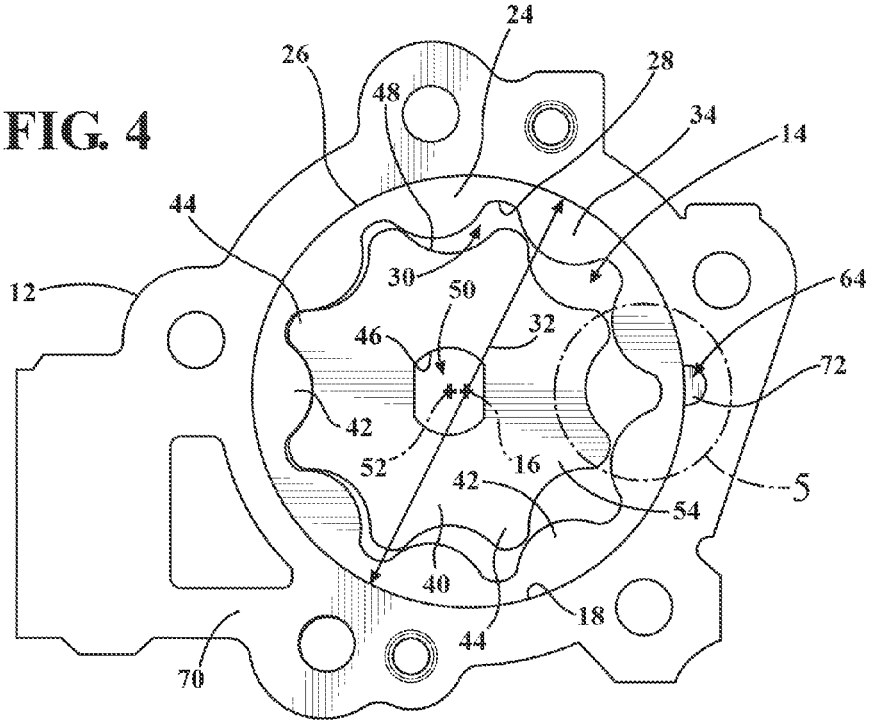
FIG. 4 is schematic end view of the housing with a first gear and a second gear disposed in the cavity.
Figure 5:
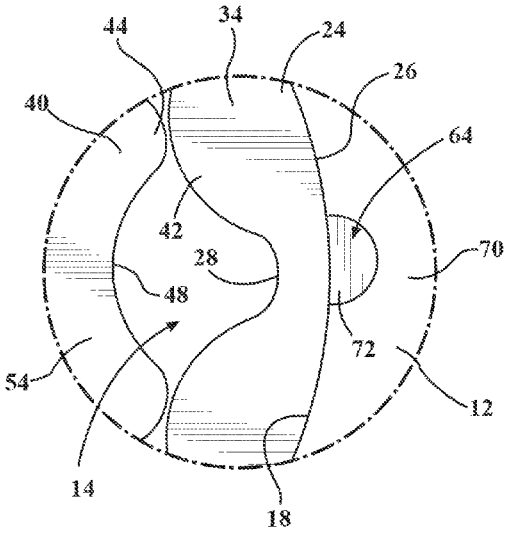
FIG. 5 is schematic enlarged view the first and second gears and a recess taken from FIG. 4.

Referring to the Figures, wherein like numerals indicate like or corresponding parts throughout the several views, a pump assembly 10 for a vehicle is generally shown in FIGS. 1 and 2.

The pump assembly 10 can be utilized to move a fluid, such as transmission fluid, a coolant, a lubricant, hydraulic fluid, etc. For example, the pump assembly 10 can be utilized to transfer transmission fluid to a transmission. As another example, the pump assembly 10 can be utilized to transfer coolant to an electric motor(s). As yet another example, the pump assembly 10 can be utilized to transfer lubricant to a gear(s) and/or a bearing(s), etc. As another example, the pump assembly 10 can be utilized to control pressure or flow of the hydraulic fluid to a clutch(s). It is to be appreciated that the pump assembly 10 can be further defined as a gear pump, such as, for example, an internal/external gear pump, etc. It is to further be appreciated that the pump assembly 10 can be any suitable pump.

Turning to FIGS. 2-5, the pump assembly 10 includes a housing 12 defining a cavity 14 extending along a central axis 16 to present a wall 18 disposed radially relative to the central axis 16 and a base 20 transverse to the central axis 16. In certain embodiments, the wall 18 defines an inner diameter 22 having a circular configuration. As such, the wall 18 defines a circumference. It is to be appreciated that the cavity 14 can be any suitable configuration.

The pump assembly 10 further includes a first gear 24 disposed in the cavity 14. The first gear 24 has a first side 26 and a second side 28 each extending along the central axis 16. The first side 26 of the first gear 24 faces the wall 18 and the second side 28 of the first gear 24 opposes the first side 26 of the first gear 24. The second side 28 of the first gear 24 defines an aperture 30 along the central axis 16, and will be discussed further below. The first side 26 of the first gear 24 is complementary to the wall 18. In certain embodiments, the first side 26 of the first gear 24 defines an outer diameter 32 having a circular configuration complementary to the inner diameter 22 of the wall 18. It is to be appreciated that the first side 26 of the first gear 24 can be any suitable configuration to cooperate with the wall 18 of the housing 12. Having the outer diameter 32 of the first gear 24 complementary to the inner diameter 22 of the wall 18 provides little clearance between the first side 26 and the wall 18.

The first gear 24 also has a front side 34 and a back side 36 opposing the front side 34. The front and back sides 34, 36 are spaced from each other along the central axis 16. The first and second sides 26, 28 are disposed between the front and back sides 34, 36. The back side 36 faces the base 20 and thus the back side 36 is disposed adjacent to the base 20. The first gear 24 defines a width 38 between the front and back sides 34, 36, which will be discussed further below.

The pump assembly 10 can also include a second gear 40 disposed in the cavity 14 and spaced from the wall 18. Specifically, the second gear 40 is disposed in the aperture 30 of the first gear 24. Therefore, the first gear 24 is disposed between the second gear 40 and the wall 18. The first gear 24 defines teeth 42 and the second gear 40 defines teeth 44 cooperating with the teeth 42 of the first gear 24 such that rotation of one of the first and second gears 24, 40 causes rotation of an other one of the first and second gears 24, 40. In one embodiment, rotation of the second gear 40 causes rotation of the first gear 24. As such, in one embodiment, the first gear 24 is referred to as a driven gear.

The second gear 40 has a first side 46 and a second side 48 each extending along the central axis 16. The second side 48 of the second gear 40 faces the second side 28 of the first gear 24. Therefore, the second side 28 of the first gear 24 defines the teeth 42 and the second side 48 of the second gear 40 defines the teeth 44. As such, the teeth 42 of the first gear 24 extends into the aperture 30 of the second side 28 of the first gear 24 and the teeth 44 of the second gear 40 extend outwardly away from the first side 46 of the second gear 40. The first side 46 of the second gear 40 defines a void 50 along a longitudinal axis 52 spaced from the central axis 16. In certain embodiments, the longitudinal axis 52 is spaced from and substantially parallel to the central axis 16.

The second gear 40 also has a front side 54 and a back side 56 opposing the front side 54. The front and back sides 54, 56 of the second gear 40 are spaced from each other along the longitudinal axis 52. It is to be appreciated that the front and back sides 54, 56 of the second gear 40 can be spaced from each other along the central axis 16. The first and second sides 46, 48 of the second gear 40 are disposed between the front and back sides 54, 56 of the second gear 40. The back side 56 of the second gear 40 faces the base 20 and thus the back side 56 of the second gear 40 is disposed adjacent to the base 20.

The pump assembly 10 can further include a motor 58 coupled to one of the first and second gears 24, 40. In one embodiment, the motor 58 is coupled to the second gear 40 for rotating the second gear 40 which rotates the first gear 24. More specifically, the motor 58 includes a shaft 60 coupled to the second gear 40 to rotate the second gear 40 about the longitudinal axis 52. Generally, the shaft 60 is disposed along the longitudinal axis 52 and rotatable about the longitudinal axis 52. It is to be appreciated that the shaft 60 can be disposed along the central axis 16. The void 50 and the shaft 60 are configured to be keyed together; therefore, rotation of the shaft 60 about the longitudinal axis 52 causes rotation of the second gear 40 about the longitudinal axis 52, and rotation of the second gear 40 causes rotation the first gear 24 about the central axis 16. It is to be appreciated that the motor 58 can be an electric motor 58, or any other suitable motor.

The motor 58 further includes a flange 62 for attaching the housing 12 to the motor 58. In other words, the housing 12 attaches to the motor 58 by the flange 62. The housing 12 can be attached to the flange 62 by any suitable component(s) and/or method(s), such as, for example, fasteners, bolts, screws, adhesive, couplers, etc.

The wall 18 defines a recess 64 adjacent to the cavity 14 and spaced from the base 20. The recess 64 is in fluid communication with the cavity 14 for providing lubrication between the wall 18 and the first side 26 of the first gear 24. The recess 64 also provides lubrication down the wall 18 of the cavity 14 and to the base 20 of the cavity 14 to lubricate the back side 36 of the first gear 24. In other words, the recess 64 also provides lubrication between the base 20 and the first gear 24. Generally, lubrication is utilized to minimize wear between the wall 18 and the first gear 24. Furthermore, lubrication is utilized to minimize wear between the base 20 and the first and/or second gears 24, 40. Hence, lubrication is utilized to minimize friction between the first gear 24 and the wall 18/base 20, as well as, the second gear 40 and the base 20. The lubrication can be defined as a lubricant, such as, for example, oil; grease; transmission fluid, such as automatic transmission fluid (ATF); etc. It is to be appreciated that any suitable lubricant can be utilized to minimize wear between the first gear 24 and the wall 18/base 20, as well as, the second gear 40 and the base 20. It is to further be appreciated that the lubricant can be disposed between the first and second gears 24, 40 to minimize wear between the gears 24, 40. In addition, it is to be appreciated that the lubricant can be disposed on the front sides 34, 54 of the first and/or second gears 24, 40 to minimize wear of the front sides 34, 54 of the first and/or second gears 24, 40.

Generally, prior to installing the pump assembly 10 in the vehicle, the first gear 24 is pre-lubricated to prevent damage to the first gear 24 and/or the pump assembly 10 when first being used. For example, prior to installing the pump assembly 10 in the vehicle, the pump assembly 10 is tested or checked for safety purposes and/or functionality purposes, etc. For illustrative purposes only, one test is performed after dry assembly clearance checks of the components which is before the pump assembly 10 performs its normal functions of moving the fluid into and out of the cavity 14. The recess 64 allows for pre-lubrication of the first gear 24, the wall 18 of the housing 12 and/or the base 20 of the housing 12 without having to handle the first and/or second gears 24, 40. As discussed above, having the outer diameter 32 of the first gear 24 complementary to the inner diameter 22 of the wall 18 provides little clearance between the first side 26 and the wall 18. Therefore, it can be difficult to remove the first and/or second gears 24, 40 from the cavity 14 of the housing 12. As such, in some instances, handling the first and/or second gears 24, 40 can damage the gears 24, 40, the housing 12, and/or other components of the pump assembly 10. Thus, the recess 64 receives the fluid/lubricant which travels into the cavity 14 between the first side 26 of the first gear 24 and the wall 18, and the fluid/lubricant travels to the base 20 of the cavity 14. Hence, lubrication of the first gear 24, the wall 18 of the housing 12 and/or the base 20 of the housing 12 can be accomplished without having to handle the first and/or second gears 24, 40.

Figure 6A:
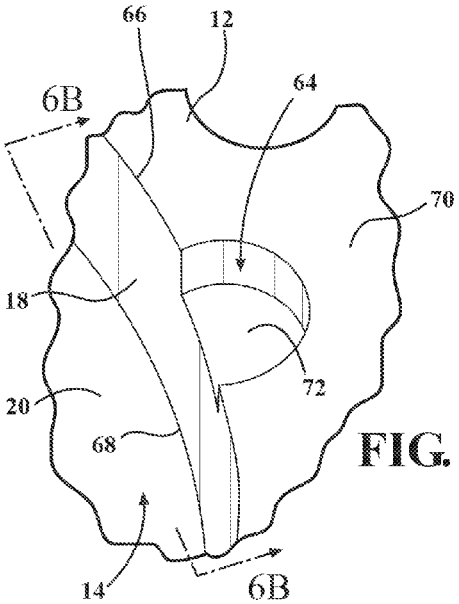
FIG. 6A is schematic enlarged perspective view of a wall and a base of the cavity and the recess.
Figure 6B:
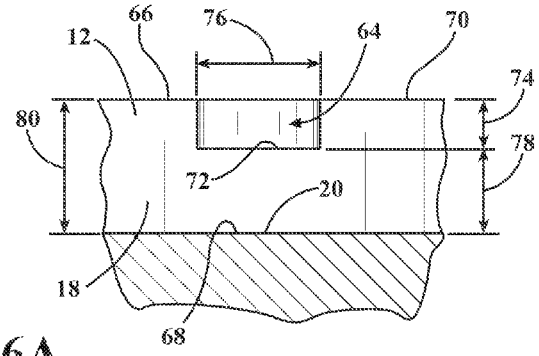
FIG. 6B is schematic cross-sectional view of the base of the cavity taken from lines 6B-6B of FIG. 6A with the wall and the recess in the background.

Also referring to FIGS. 6A and 6B, the housing 12 presents a face 70 adjacent to the wall 18 and spaced from the base 20. Generally, the face 70 is spaced substantially parallel to the base 20. Furthermore, the face 70 is disposed transverse to the central axis 16 and includes a first edge 66 adjacent to the wall 18. Simply stated, the face 70 and the wall 18 meet at the first edge 66. The recess 64 intersects the first edge 66 such that the face 70 further defines the recess 64 and the first edge 66 defines a non-continuous configuration. In one embodiment, the face 70 is perpendicular to the central axis 16.

In addition, the base 20 includes a second edge 68 spaced from the first edge 66 along the central axis 16. Therefore, the face 70 and the base 20 are spaced from each other. The second edge 68 is adjacent to the wall 18 and defines a continuous configuration. Simply stated, the base 20 and the wall 18 meet at the second edge 68.

The recess 64 extends along a portion of the wall 18 along the central axis 16, and thus, the recess 64 fails to extend along the entire wall 18 along the central axis 16 as discussed further below. Therefore, generally, the wall 18 is substantially continuous which provides improved flow stability of the pump assembly 10. Furthermore, the wall 18 is substantially continuous which provides for predictable positioning of the first gear 24 in the cavity 14 during rotation about the central axis 16. In other words, the first gear 24 is more stable in the cavity 14 during rotation about the central axis 16 when the wall 18 is substantially continuous. In addition, having the wall 18 being substantially continuous, an oil film can develop on the first side 26 of the first gear 24 consistently and/or in a predictable manner.

The recess 64 extends along the central axis 16 toward the base 20 to present a bottom 72 spaced from the base 20. More specifically, the recess 64 extends along the central axis 16 toward the base 20 to present the bottom 72 spaced from the second edge 68 of the base 20. In other words, the recess 64 extends toward the base 20 substantially parallel to the central axis 16. Generally, the bottom 72 is spaced substantially parallel to the base 20.

The recess 64 defines a first height 74 between the face 70 and the bottom 72. Furthermore, the recess 64 defines a width 76 transverse to the first height 74 of the recess 64. Generally, the width 76 of the recess 64 is less than the circumference of the wall 18. In other words, the width 76 of the recess 64 fails to extend the entire circumference of the wall 18. In certain embodiments, the width 76 is from about 75% to about 99% less than the circumference. In other embodiments, the width 76 is from about 85% to about 95% less than the circumference. In yet other embodiments, the width 76 is from about 90% to about 95% less than the circumference.

The wall 18 defines a second height 78 between the bottom 72 and the base 20. Generally, the second height 78 is equal to or greater than the first height 74. In other words, the second height 78 of the wall 18 is equal to or greater than the first height 74 of the recess 64. In certain embodiments, the second height 78 is greater than the first height 74. Furthermore, the wall 18 defines a total height 80 between the face 70 and the base 20, with the width 38 of the first gear 24 being equal to the total height 80 of the wall 18. Therefore, generally, the total height 80 of the wall 18 is greater than the second height 78 of the wall 18. In certain embodiments, the first height 74 is from about 50% to about 99% less than the total height 80. In other embodiments, the first height 74 is from about 65% to about 90% less than the total height 80. In yet other embodiments, the first height 74 is from about 80% to about 85% less than the total height 80. Therefore, the recess 64 fails to extend along the entire height of the wall 18. It is to be appreciated that the width 38 of the first gear 24 can be less than or greater than the total height 80 of the wall 18.

Having the first height 74 of the recess 64 being less than the total height 80 of the wall 18 provides for predictable positioning of the first gear 24 in the cavity 14 during rotation about the central axis 16. In other words, the first gear 24 is more stable in the cavity 14 during rotation about the central axis 16 when the first height 74 of the recess 64 is less than the total height 80 of the wall 18. Furthermore, having the first height 74 of the recess 64 being less than the total height 80 of the wall 18 allows the oil film to develop on the first side 26 of the first gear 24 consistently and/or in a predictable manner.

Referring back to FIGS. 2 and 3, the base 20 defines a first slot 82 and a second slot 84 spaced from each other and spaced from the wall 18. In certain embodiments, the first and second slots 82, 84 are each elongated and disposed radially relative to the central axis 16. The first slot 82 includes a first end 86 and a second end 88 spaced from each other transverse to the central axis 16. Similarly, the second slot 84 includes a first end 90 and a second end 92 spaced from each other transverse to the central axis 16. In one embodiment, the first slot 82 generally decreases in size from the first end 86 to the second end 88 of the first slot 82. Likewise, the second slot 84 generally decreases in size from the first end 90 to the second end 92 of the second slot 84. The first and second slots 82, 84 are configured to move the fluid through the cavity 14. For example, as the first and second gears 24, 40 rotate, the fluid is drawn into the cavity 14 through one of the first and second slots 82, 84 and out of the cavity 14 through an other one of the first and second slots 82, 84. Specifically, as the gears 24, 40 open or separate from each other during rotation, suction is created which draws the fluid into the cavity 14 through the first slot 82 and as the gears 24, 40 close or come together during rotation, pressure is created which forces the fluid out of the cavity 14 through the second slot 84.

The first end 86, 90 of the first and second slots 82, 84 are spaced a first distance 94 from each other to define a first region 96 therebetween. Furthermore, the second end 88, 92 of the first and second slots 82, 84 are spaced a second distance 98 from each other to define a second region 100 therebetween. Generally, the first distance 94 is greater than the second distance 98. The first and second regions 96, 100 will be discussed further below.

The housing 12 defines a first plane 102 disposed transverse to the central axis 16 and substantially parallel to the face 70 of the housing 12. Furthermore, the base 20 of the cavity 14 is disposed substantially parallel to the first plane 102. As such, as discussed above, the face 70 and the base 20 are spaced substantially parallel to each other. In addition, the bottom 72 of the recess 64 is disposed substantially parallel to the first plane 102. In one embodiment, the face 70 is disposed along the first plane 102 and thus the recess 64 extends toward the base 20 of the cavity 14 perpendicular to the first plane 102. It is to be appreciated that the recess 64 can extend toward the base 20 transverse to the first plane 102.

Furthermore, the housing 12 defines a second plane 104 disposed transverse to the first plane 102. The second plane 104 is spaced from the first and second slots 82, 84 such that the second plane 104 intersects the first and second regions 96, 100, and the second plane 104 intersects the recess 64. In one embodiment, the second plane 104 is disposed perpendicular to the first plane 102, with the second plane 104 spaced from the first and second slots 82, 84 and the second plane 104 intersecting the recess 64. In certain embodiments, the second plane 104 intersects the recess 64 off-center. In other embodiments, the second plane 104 can intersect the recess 64 through the center of the recess 64. It is to be appreciated that the second plane 104 can intersect the recess 64 at any suitable location. In addition, it is to be appreciated that the second plane 104 can intersect the first and second regions 96, 100 at any suitable location.

In certain embodiments, the recess 64 is spaced a proximal distance from the first region 96 and the recess 64 is spaced a distal distance from the second region 100. Generally, the proximal distance is less than the distal distance. In other words, in certain embodiments, the recess 64 is disposed adjacent to the first region 96 and thus spaced farther away from the second region 100 than the first region 96. The recess 64 is located where the second plane 104 intersects the recess 64 and the recess 64 is spaced the proximal distance from the first region 96 such that the oil film develops on the first side 26 of the first gear 24 consistently, in the predictable manner, and/or allows predictable positioning of the first gear 24 in the cavity 14 during rotation about the central axis 16. In other embodiments, the recess 64 is disposed adjacent to the second region 100 and thus spaced farther away from the first region 96 than the second region 100. As such, it is to be appreciated that the recess 64 can be disposed in other suitable locations. It is to further be appreciated that when the recess 64 is disposed adjacent to the second region 100, the second plane 104 intersects the recess 64.

In addition to the above, the pump assembly 10 can include other components, which are not discussed in detail herein. For example, the pump assembly 10 can include a filter 106 coupled to the cavity 14 of the housing 12 for filtering the fluid and guiding the fluid into the cavity 14. As another example, the pump assembly 10 can include a pin 108 mounted to the housing 12 and extending into the cavity 14 along the longitudinal axis 52 for receiving the second gear 40 such that the second gear 40 rotates about the pin 108. As yet another example, the pump assembly 10 can include a bushing 110 disposed between the pin 108 and the second gear 40 such that the second gear 40 rotates on the bushing 110. In addition, the housing 12 can define an inlet 112 adjacent to the first slot 82 and in fluid communication with the first slot 82 and thus the cavity 14 for guiding the fluid into the housing 12. Generally, the inlet 112 is in fluid communication with the filter 106. Additionally, the housing 12 can define an outlet 114 adjacent to the second slot 84 and in fluid communication with the second slot 84 and thus the cavity 14 for guiding the fluid out of the housing 12.

While the best modes for carrying out the disclosure have been described in detail, those familiar with the art to which this disclosure relates will recognize various alternative designs and embodiments for practicing the disclosure within the scope of the appended claims.

What is claimed is:

1. A pump assembly for a vehicle, the assembly comprising:

a fixed housing including an inner wall defining a cavity extending along a central axis, with the cavity ending at a base of the fixed housing, with the inner wall of the fixed housing disposed radially relative to the central axis and the base disposed adjacent to the inner wall;

a first gear disposed in the cavity and having a first side and a second side each extending along the central axis, with the first side facing the inner wall and the second side opposing the first side, and wherein the first side of the first gear and the inner wall are complementary to each other such that the inner wall adjacently surrounds the first side; and the inner wall defining a recess adjacent to the cavity and the recess is axially spaced from the base relative to the central axis, with the recess facing the first side of the first gear, and the recess being in fluid communication with the cavity for providing lubrication between the inner wall and the first side of the first gear;

wherein the recess extends along the central axis toward the base and ends at a bottom wall of the fixed housing such that the bottom wall is spaced from and substantially parallel to the base.

2. The assembly as set forth in claim 1 wherein the fixed housing presents a face disposed transverse to the central axis that includes a first edge adjacent to the inner wall, with the recess intersecting the first edge such that the face further defines the recess and the first edge defines a non-continuous configuration.

3. The assembly as set forth in claim 2 wherein the base includes a second edge spaced from the first edge along the central axis, with the face and the base being spaced from each other, and the second edge being adjacent to the inner wall and defining a continuous configuration; wherein the base and the inner wall of the fixed housing are formed of one-piece.

4. The assembly as set forth in claim 3 wherein the recess extends along the central axis toward the base to present a bottom wall of the fixed housing spaced axially from the second edge of the base relative to the central axis, with the recess defining a first height from the face to the bottom wall, and the inner wall defining a total height from the face to the base.

5. The assembly as set forth in claim 4 wherein the first height is from about 50% to about 99% less than the total height.

6. The assembly as set forth in claim 4 wherein the first height is from about 65% to about 90% less than the total height.

7. The assembly as set forth in claim 4 wherein the first height is from about 80% to about 85% less than the total height.

8. The assembly as set forth in claim 4 wherein the inner wall defines a second height between the bottom wall and the base, with the second height greater than the first height.

9. The assembly as set forth in claim 1 wherein the base defines a first slot and a second slot spaced from each other and spaced from the inner wall, with the first and second slots each being elongated and disposed radially relative to the central axis.

10. The assembly as set forth in claim 9 wherein the first slot includes a first end and a second end spaced from each other transverse to the central axis, and the second slot includes a first end and a second end spaced from each other transverse to the central axis.

11. The assembly as set forth in claim 10 wherein the first end of the first and second slots are spaced a first distance from each other to define a first region therebetween, and the second end of the first and second slots are spaced a second distance from each other to define a second region therebetween, with the first distance being greater than the second distance.

12. The assembly as set forth in claim 11 wherein the fixed housing presents a face adjacent to the inner wall and spaced from the base, with the face disposed transverse to the central axis and further defining the recess.

13. The assembly as set forth in claim 12 wherein the fixed housing defines a first plane disposed transverse to the central axis and substantially parallel to the face of the fixed housing, and the fixed housing defines a second plane disposed transverse to the first plane, with the second plane spaced from the first and second slots such that the second plane intersects the first and second regions, and the second plane intersects the recess.

14. The assembly as set forth in claim 9 wherein the fixed housing presents a face adjacent to the inner wall and spaced from the base, with the face disposed transverse to the central axis and further defining the recess, and the fixed housing defines a first plane disposed transverse to the central axis and substantially parallel to the face of the fixed housing, and the fixed housing defines a second plane disposed perpendicular to the first plane, with the second plane spaced from the first and second slots and the second plane intersecting the recess.

15. The assembly as set forth in claim 10 wherein the first slot generally decreases in size from the first end to the second end of the first slot, and the second slot generally decreases in size from the first end to the second end of the second slot.

16. The assembly as set forth in claim 11 further including the recess being spaced a proximal distance from the first region and the recess being spaced a distal distance from the second region, with the proximal distance less than the distal distance.

17. The assembly as set forth in claim 1 further including a second gear disposed in the cavity and spaced from the inner wall, with the first gear being disposed between the second gear and the inner wall and wherein the first gear defines teeth and the second gear defines teeth cooperating with the teeth of the first gear such that rotation of one of the first and second gears causes rotation of an other one of the first and second gears.

18. The assembly as set forth in claim 1 wherein the first side of the first gear defines an outer diameter having a circular configuration, and the inner wall defines an inner diameter having a circular configuration; wherein the fixed housing presents a face that includes a first edge adjacent to the inner wall, with the recess intersecting the first edge, and the base includes a second edge spaced from the first edge, and the second edge has a circular configuration.

19. A pump assembly for a vehicle, the assembly comprising:

a housing defining a cavity extending along a central axis to present a wall disposed radially relative to the central axis and a base transverse to the central axis;

a first gear disposed in the cavity and having a first side and a second side each extending along the central axis, with the first side facing the wall and the second side opposing the first side, and the first side of the first gear complementary to the wall;

a second gear disposed in the cavity and spaced from the wall, with the first gear being disposed between the second gear and the wall;

the first gear defining teeth and the second gear defining teeth cooperating with the teeth of the first gear such that rotation of one of the first and second gears causes rotation of an other one of the first and second gears;

a motor coupled to the second gear for rotating the second gear which rotates the first gear, with the motor including a flange for attaching the housing to the motor; and wherein the wall defines a recess adjacent to the cavity and spaced from the base, with the recess in fluid communication with the cavity for providing lubrication between the wall and the first side of the first gear;

wherein the housing presents a face disposed transverse to the central axis and including a first edge adjacent to the wall, with the recess intersecting the first edge such that the face further defines the recess and the first edge defines a non-continuous configuration;

wherein the base includes a second edge spaced from the first edge along the central axis, with the face and the base being spaced from each other, and the second edge being adjacent to the wall and defining a continuous configuration;

wherein the base defines a first slot and a second slot spaced from each other;

wherein the recess extends along the central axis toward the base to present a bottom spaced from the second edge of the base, with the recess defining a first height between the face and the bottom, and the wall defining a total height between the face and the base, and the first height is from about 80% to about 85% less than the total height;

wherein the housing defines a first plane disposed transverse to the central axis and substantially parallel to the face of the housing, and the housing defines a second plane disposed transverse to the first plane, with the second plane spaced from the first and second slots, and the second plane intersecting the recess.

20. A pump assembly for a vehicle, the assembly comprising:

a fixed housing including an inner wall defining a cavity extending along a central axis, with the cavity ending at a base of the fixed housing, with the inner wall of the fixed housing disposed radially relative to the central axis and the base disposed adjacent to the inner wall;

a first gear disposed in the cavity and having a first side and a second side each extending along the central axis, with the first side facing the inner wall and the second side opposing the first side, and wherein the first side of the first gear and the inner wall are complementary to each other such that the inner wall adjacently surrounds the first side; and the inner wall defining a recess adjacent to the cavity and the recess is axially spaced from the base relative to the central axis, with the recess facing the first side of the first gear, and the recess being in fluid communication with the cavity for providing lubrication between the inner wall and the first side of the first gear;

wherein the base defines a first slot and a second slot spaced from each other and spaced from the inner wall, with the first and second slots each being elongated and disposed radially relative to the central axis;

wherein the fixed housing presents a face adjacent to the inner wall and spaced from the base, with the face disposed transverse to the central axis and further defining the recess, and the fixed housing defines a first plane disposed transverse to the central axis and substantially parallel to the face of the fixed housing, and the fixed housing defines a second plane disposed perpendicular to the first plane, with the second plane spaced from the first and second slots and the second plane intersecting the recess.

* * * * *